United States Patent [19]

Staton

[11] 4,414,767

[45] Nov. 15, 1983

[54] ROOM DECORATION

[76] Inventor: Eric Staton, 34 Broad Walk, Winchmore Hill, London N.21, England

[21] Appl. No.: 293,940

[22] Filed: Aug. 18, 1981

[30] Foreign Application Priority Data

Aug. 26, 1980 [GB] United Kingdom ..... 8027600

[51] Int. Cl.[3] ..... G09F 19/00

[52] U.S. Cl. ..... 40/429; 40/160

[58] Field of Search ..... 40/160, 472, 471, 518, 40/429, 428/13; 272/22, 23

[56] References Cited

U.S. PATENT DOCUMENTS

| | | | |
|---|---|---|---|
| 920,593 | 5/1909 | Leslie | 40/160 |
| 2,419,802 | 4/1947 | Van Horne | 40/471 |
| 2,702,440 | 2/1955 | Marchand | 40/472 |
| 2,952,931 | 9/1960 | Manduca | 40/518 |
| 3,829,998 | 8/1974 | Flax | 40/160 |

FOREIGN PATENT DOCUMENTS

| | | | |
|---|---|---|---|
| 526958 | 5/1955 | Italy | 40/160 |

*Primary Examiner*—Gene Mancene
*Assistant Examiner*—Wenceslao J. Contreras
*Attorney, Agent, or Firm*—Cushman, Darby & Cushman

[57] ABSTRACT

A decoration structure, especially a decoration for a room, has a frame structure bounding an opening within which to present to view a background element bearing first subject matter, such as a scene or an abstract design, and a foreground element through or past which the background element can be viewed, the foreground element being spaced sufficiently from the background element to be clearly spaced to the viewer and so as to cause an apparent relative movement when there is relative movement with respect to the viewer. Illumination is provided for at least the background element. One or both of the elements may have small colored zones in a transparent or translucent sheet for change of transmitted color, to the viewer, as relative movement occurs.

5 Claims, 10 Drawing Figures

ROOM DECORATION

This invention relates to a decoration structure, to enhance the appearance of, for example, a room and provide a point of interest on a wall.

Many rooms of houses, flats and other living quarters are of "single aspect" only, and/or have windows which are too small for adequate light to enter, and/or look out on a generally unattractive exterior scene.

It is the general object of this invention to provide an improved form of room decoration which, whilst not being restricted to such use, is of particular utility in providing an abstract design or an illusion of an attractive "external" scene and especially of making a room appear to entail more "aspect" than its building construction in fact supplies.

According to the present invention a decoration structure, especially for a room, comprises a structure bounding an opening within which to present to view a background sheet bearing subject matter such as a scene, a foreground element as hereinafter defined positioned forwardly of the background sheet, and means for illumination of at least part of the background sheet, or of the background sheet and the foreground sheet.

Means may advantageously be provided for storage of a plurality of foreground elements and/or of background elements, and permitting any selected one of said elements to be presented to view within the bounding structure.

The term "foreground element" as used in this specification is intended to mean nay form of two- or three-dimensional article, cut-out, silhouette, printed or painted or otherwise prepared subject matter through which, or through the transparent or translucent or omitted parts of which the scene sheet can be viewed, the spacing between the scene sheet and the foreground element being such that there is obtained an obvious difference of distance from the viewer placed in front of the structure.

The structure may advantageously be embellished with surrounds, shelving, curtains, pelmets, decorations and other material enhancing its appearance and simulating a normal window structure.

The plurality of sheets may be arranged serially end to end to form a strip which may be wound on end rollers, or may be passed about a set of rollers as a continuous loop. The viewed sheet is advantageously distinct from the foreground element, but a single strip or loop may contain subject matter for both the viewed scene and the foreground element.

Means are advantageously provided for advancement of the strip by rotating one or more rollers, and such means preferably make provision for rotation in only one direction, say until an end of a strip is reached, at which point the entire roller mechanism can be reversed, or become reversed automatically. However, provision may be made for over-riding the non-reverse system when desired.

Strip winding means may be made automatically self-setting, e.g. by visual-electronic means which automatically stop the strip in a position in which a scene is centered in the viewing opening.

A plurality of foreground elements may be provided, e.g. on another strip which is also passed about rollers, either as a non-continuous or as a loop-form strip.

The main "scene" may be made up of two scenic elements, e.g. parts of respective strips, which are placed one in front of the other, the composite scene then cooperating with a foreground element placed in front of them.

The lighting means may comprise light sources disposed to the rear of the viewed scene sheet, and preferably they are removable, e.g. for ease of servicing, or are shiftable to a stored position in which they do not obstruct the viewing opening.

The structure as a whole is preferably provided with any suitable means for attachment to a wall, or hanging on a wall, or may be stood on any convenient support.

In order that the nature of the invention may be readily ascertained, some embodiments of decoration structure in accordance therewith are hereinafter particularly described by way of non-limiting example with reference to the figures of the accompanying drawings, wherein.

Figure 1:
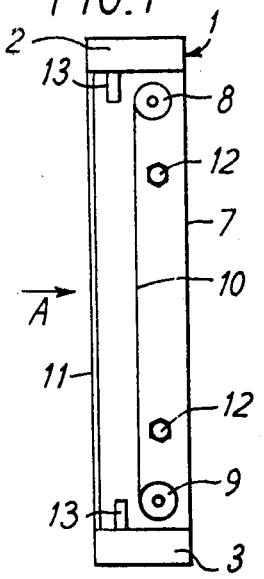
FIG. 1 is a side elevation of a first embodiment of decoration structure.

Referring to FIG. 1, there is shown a frame structure 1 composed of upper and lower cross-members 2,3 and side uprights 4,5 which bound a viewing opening 6 intended to be viewed in the direction of the arrow "A." The frame is shown as being fitted with a rear wall 7, but this need not necessarily be provided, and could be replaced by a portion of a wall of a room, if a background is required.

Within the enclosure formed by the members 2–5 there are provided upper and lower horizontal rollers 8,9 upon which is rolled a continuous strip 10 of transparent or translucent material, e.g. acetate film or a suitable polymer plastics material, the length of the strip being at least a whole multiple of the gap between the rollers, such that a plurality of scenes or other decorative subject matter may be provided on the strip 10 and such that, by appropriate rotation of the rollers, any selected one of the plurality of scenes may be brought into position in the viewing opening 6. The rollers are advantageously removable as a whole for changing, e.g. by axial withdrawal of a respective journal shaft positioned at least at one end of the roller.

At a front face of the structure 1 there is provided a "foreground" element 11. This may be in the form of a transparent or translucent sheet which covers all or part of the viewing opening 6, or may be a non-transparent or non-translucent solid or open-work mask which occludes only a part of the viewing opening 6. The intention is that the foreground element shall cooperate with any selected scene of the roller strip 10 so that, with the foreground element being spaced slightly forwardly of the strip 10, there is obtained an obvious relative movement to the eye of the beholder when moving the eye relative to the structure as a whole, thereby to give an impression of "depth" of the composite foreground-plus-scene. By way of illustration, the foregoing element could be a transparent film, or a sheet of glass, on which a representation of a set of railings is printed, painted or bonded to represent the iron-work of a balcony, or again it could be a solid (i.e. non light-transmitting) partially cut out sheet of the shape of a set of railings of a balcony iron-work. There could be provided two sheets of glass or clear plastics, with the subject matter contained between them. Other subject matter for the foreground could be trees, flowers, rocks, parts of buildings, etc., and it is stressed that the subject matter per se does not form part of the essence of the invention, and could vary infinitely with the subject matter of the strip 10.

In the structure 1 there are provided means for casting light onto the strip 10 and, if desired, onto or through the foreground element 11. Such lighting may be selective of an area or areas of the strip 10 or element 11, or cast over the whole area thereof. In a preferred arrangement, the lighting is provided by lighting elements 12, such as fluorescent tubes, disposed to the rear of the strip 10 and providing direct illumination. However, the lighting elements could be placed at top, bottom, or side(s) of the structure, so as to be out of the opening 6, and provide their illumination obliquely, or through reflector or mirror means arranged in the structure.

The structure may be adapted to be placed in, or over, an existing window opening, say for the purpose of normally hiding an undesirable view from the window. Nevertheless, it may be desired from time to time to have daylight received unobstructed through the window, in which case the strip 10 may include one or more totally blank (transparent or translucent) areas amongst its scenes, and the lighting means 12, if not already positioned offset from the opening 6, may be arranged to move away clear of the opening, e.g. the lighting unit as a whole may be a detachable panel, for ease of servicing also. It will be appreciated that natural daylight may be used, when available, to replace the light of the lighting means 12.

The structure 1 would preferably include a front fascia or surround 13 at least at top and bottom of the opening 6, to hide the rollers 8,9 from view from the front.

As so far described, the decoration structure could be secured on a wall, or stood on a piece of furniture against a wall, or made free-standing, or included in or over a window opening. By use of the lighting effect on the scene of the strip 10, in addition to the optical effect of the foreground element, there is obtained a pleasing illuminated scene with an effect of depth which is immediately apparent to the eye as soon as the head is moved relative to the structure up and down or laterally, and towards and away from the structure.

Advantageously, the strip 10 is made long enough to contain a substantial number of scenes, and would therefore require to be at least several meters in length. For this reason, the rollers 8,9 are advantageously provided with end plates to retain the strip carefully centered thereon, and are generally otherwise carefully manufactured and positioned to be truly parallel. The rollers may be rotated manually to shift from one scene to another. To avoid distortion of the strip, provision is preferably made for each roller to include a one-way permissive brake, or a one-way drive, so that, at least when travelling one way along the strip, it is temporarily impossible to reverse a roller so as to feed the strip back into the opening 6. Such non-reverse means may nevertheless be subject to an over-ride, to permit minor adjustment when the user has inadvertently overwound for any selected scene.

The rollers may be controlled by a drive motor, e.g. an electric motor, and advantageously means are provided for automatic stoppage of the motor after a scene has been moved into correct position, e.g. a light-cell cooperating with light or dark elements provided on the strip, say at an edge thereof. Such a drive means may have controls permitting selection of any scene, or a plurality of scenes, by operation of a selector control, e.g. a knob or buttons, of a control box, whereby the user can set the control to, say, "scene No. 8" and the motor drive will automatically seek that scene and position it in the opening 6. Such an arrangement could be obtained by providing light/dark signals, e.g. eight light or dark strips for "scene No. 8," at an edge of the scene strip, and providing a light-cell cooperating with a micro-chip and integrated circuit controlling the motor to hunt until the scene indicator signals match up with the selector setting.

Although the more forwardly situated of the two elements contributing to the total esthetic effect has been referred to as the "foreground," it is envisaged that the subject matter of the element 11 need not necessarily be of the nature of a foreground, but may simply be a portion of subject matter which can merge with, or generally be associated with, the scene subject matter of the strip 10.

The subject matter of the element 11 would most conveniently be substantially flat, e.g. printed or cut out from sheet material, but need not necessarily be so, and could consist of or include three-dimensional subject matter, e.g. simulations of sprays or flowers, or static objects.

Figure 2:
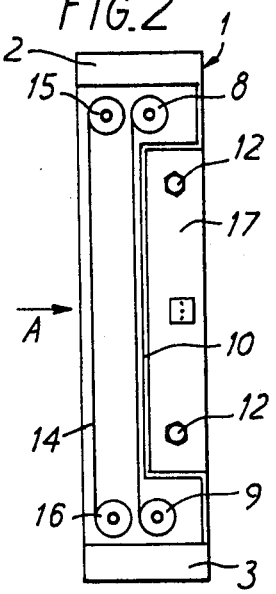
FIG. 2 is a side elevation of a second embodiment of decoration structure.

Referring now to FIG. 2 of the drawings, there is shown a second embodiment in which the structure and the options available thereon are similar, but in which the single fixed foreground element 11 is replaced by a second strip 14 which again contains a plurality of foreground (or other) types of subject matter, and which is carried on rollers 15,16, whereby a much larger possibility of varying the scene content is made available. For example, any one of 10 foregrounds may be used in conjunction with any one of 10 main scenes, to give a total of 100 variations. Again, where automatic control is provided, the selector mechanism may be such as only to position each main scene in conjunction with an appropriate foreground.

This figure shows also that the lighting means, illustrated by way of example as fluorescent strips, may be housed in a service panel 17 which is detachable as a whole for ease of servicing, and/or to leave the opening 6 unobstructed for normal daylight to pass through the structure.

Figure 3:
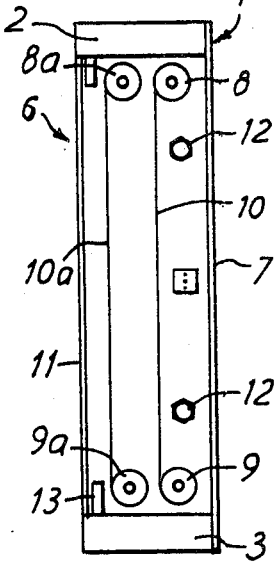
FIG. 3 is a side elevation of a third embodiment of decoration structure.

Referring to FIG. 3, there is shown a further embodiment in which the structure and the options available thereto are similar but wherein there are provided two sets of rollers 8,9 and *8a,9a* each of which carries a respective strip 10,10*a* and the scene subject matter of each portion of the respective strips is arranged to marry up with that of the other strip, to provide a generally more complex scene. There is again provided a "foreground" element 11 which is adapted to cooperate with the (composite) scene of the two strips 10,10*a*.

Figure 4:
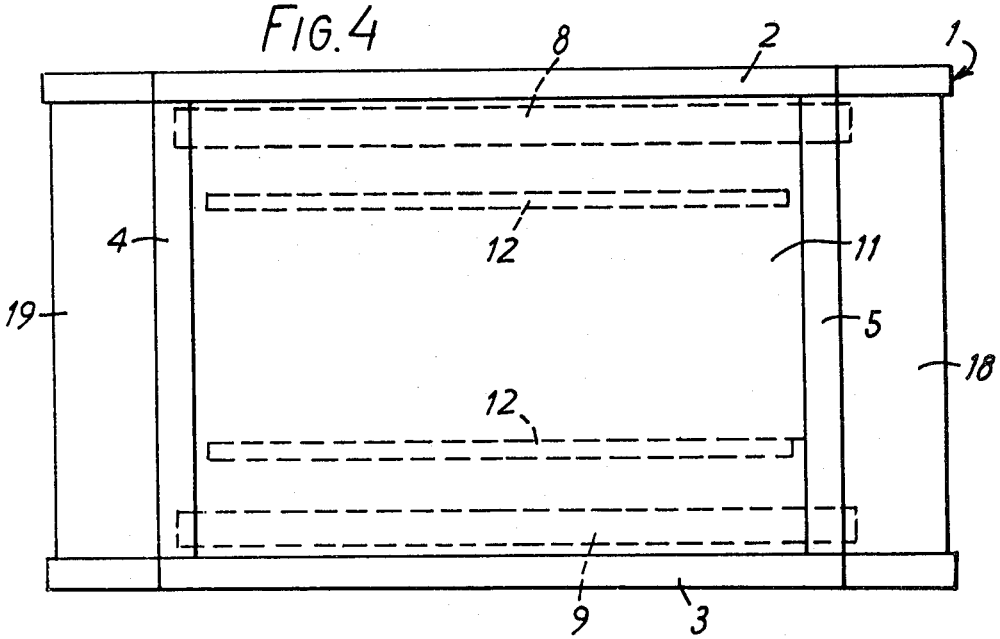
FIG. 4 is a front elevation which corresponds, with minor variations, to each of the three embodiments of FIGS. 1, 2 and 3.
Figure 5:
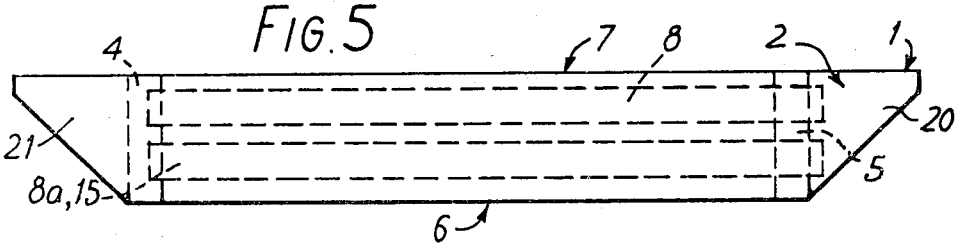
FIG. 5 is a plan view which corresponds to FIG. 4.
Figure 6:
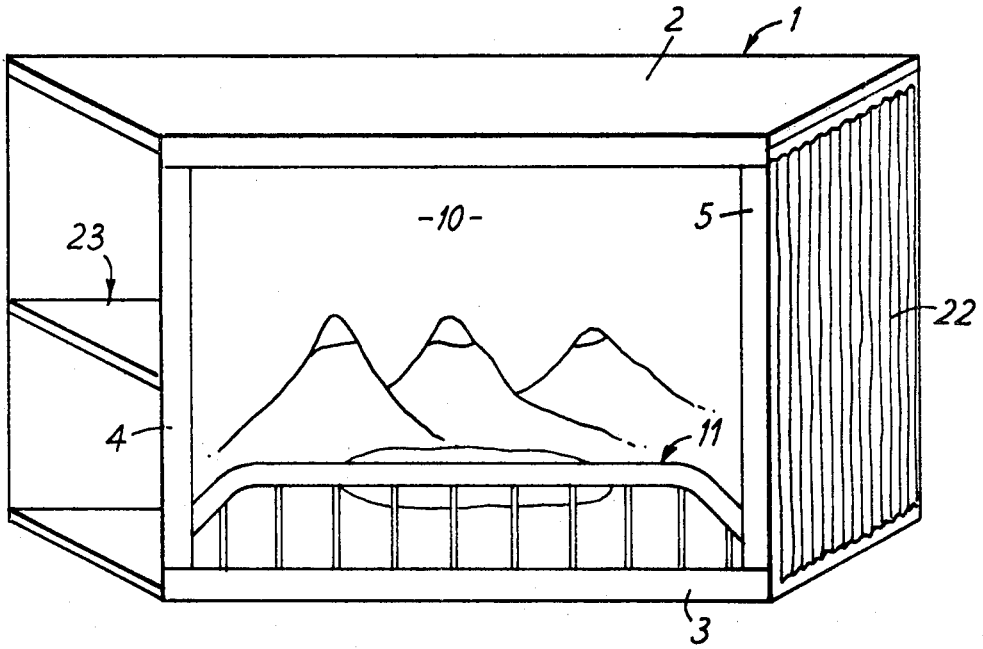
FIG. 6 shows a perspective front elevation of a modification of the structure of FIGS. 4 and 5.
Figure 7:
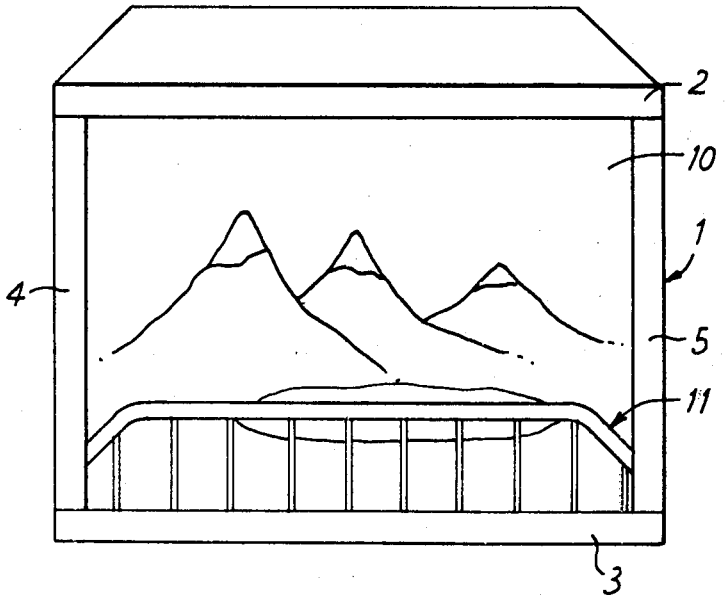
FIG. 7 shows a perspective front elevation of another structure which corresponds, with minor variations, to each of the embodiments of FIGS. 1, 2 and 3.

Referring now to FIGS. 4 and 5, there is shown by way of non-limiting example a possible general appearance for the structure, e.g. with side extensions 18,19 to enhance the general appearance of the frame structure, and providing small shelf areas 20,21 which may be left plain, or may themselves be decorated or used for decorative material or objects. As shown in FIG. 6, the appearance of the structure as a whole may be further improved by adding dress curtains 22 (shown at one side only) and/or additional shelving 23, or again there could be added a full set of curtains to be drawn completely across the structure. FIG. 7 shows the basic frame without the added shelving or curtains etc., where a simple structure is required, especially for placing into or over an existing window opening.

Appropriate dimensions could be, by way of example, a height of 3 ft., a width of 4 ft., and a forward projection of 6 inches. The foreground element might be positioned about 2 inches forwardly of the main scene strip 10, and where more than one strip 10 is provided they may be positioned for example with one forward of the other by about 2 inches.

The structure may be used to provide a room with a multiple view or a selectable view, or both, and for example a number of scenic views, e.g. Swiss Alps scenes, may be provided in realistic colour printed transparencies on large sheets of clear film, a number of scenes being joined together to form the continuous strip, or a length of strip printed with the various scenes. Only one scene at a time is displayed, but by making it a composite scene with (at least) a "foreground" element, there may be provided a very realistic "second window" or "double aspect" to a room, with the possibility of changing the view from, for example, a beach scene to "London at night" and to "Mountain scene" and so on.

Provision is advantageously made for variation of light effects, for example by use of moving light beams, changing colours, dimming, introduction of screens, changing intensities, and any combination thereof, and the variations, including such items as cloud effects by use of rotating stencils or screens, may be programmed to follow in succession or in a repeated cycle.

Figure 8:
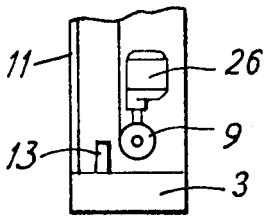
FIG. 8 is a view siimilar to that of FIG. 1 but showing a modification wherein there is provided a motor drive for simple or reciprocating motion of a rear strip.
Figure 9:
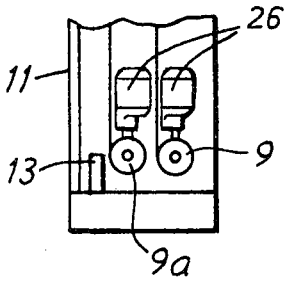
FIG. 9 is a view similar to that of FIG. 3, but showing a modification wherein there are provided motor drives for simple or reciprocating motion of two rear strips.
Figure 10:
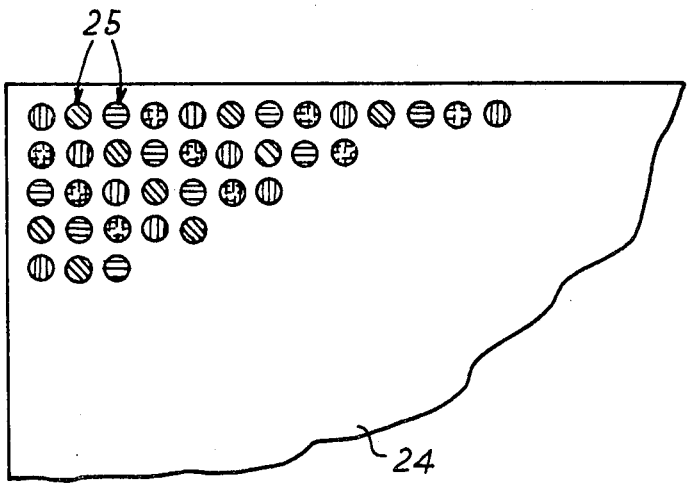
FIG. 10 is an elevation, to a very much enlarged scale, of a portion of a modified strip suitable for forming a foreground element or a background element.

Referring now to FIGS. 8,9 and 10, there is described a further embodiment wherein a particular visual effect is obtained by the use of a foreground element and/or a background or "scene" element made of a material which incorporates transparent or translucent areas which are made differently coloured or are left white or plain. An example is shown in FIG. 10 wherein a transparent film has a number of small zones 25 coloured, for example, red, yellow, blue or green in a symmetrical arrangement (as shown) or any desired non-symmetrical arrangement, the zones being separated by areas of non-coloured film. This film material is used for the front foreground element and/or for the rear scene element. Due to the separation of those elements, and where relative movement of the viewer's eye causes change of positioning of differently coloured zones one in front of another, there is a change of colour presented to the viewer's eye, giving an enhanced decorative effect, especially where the foreground or the scene is an abstract pattern or design.

FIGS. 8 and 9 show how one or both of the rearward scene screens can be caused to reciprocate slowly by means of drive motor units 26 having appropriate speed-reduction and reversing systems included in them. The front screen 11 may likewise be made movable, and be moved by a similar motor drive.

I claim:

1. A decoration structure, especially for a room, comprising a stationary structure bounding an opening, an elongate background strip bearing serially on a face thereof a plurality of items of background subject matter each of which is of such dimensions as to occupy the opening of the structure, respective roller means on said structure at spaced positions at each side of said opening to carry said background strip and permit rolling up and unrolling of said strip for the presentation of a selected item in said opening, a foreground element positioned on said structure in said opening and having an item of foreground subject matter adapted to cooperate with the selected background item in the formation of an entire scene, and foreground element being spaced forwardly of said background strip, and means on said structure for illumination of at least part selectively of the background item of the foreground item, wherein selectively the foreground item and the background item is transparent or translucent and comprises a plurality of zones which are different coloured and which are arranged symmetrically or non-symmetrically.

2. A decoration structure, as claimed in claim 1, including at least one further background element.

3. A decoration structure, as claimed in claim 1, wherein at least some coloured zones are separated by non-coloured preferably transparent areas.

4. A decoration structure, as claimed in claim 1, comprising motor means for slow relative movement of one element with respect to at least one other element.

5. A decoration structure, as claimed in claim 1, wherein said elongated background strip is a closed loop, and wherein there are provided motor means for driving said roller means for presentation of a desired background item in said opening.

* * * * *